US006305043B1

(12) United States Patent
Rosnak

(10) Patent No.: US 6,305,043 B1
(45) Date of Patent: Oct. 23, 2001

(54) PAINT APPLICATOR HAVING EXTENSION-RECEIVING ADAPTER NORMALLY WITHIN PIVOTAL HANDLE

(75) Inventor: Robert F. Rosnak, Depew, NY (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/262,473

(22) Filed: Mar. 4, 1999

(51) Int. Cl.[7] ..... B05C 17/00

(52) U.S. Cl. ..... 15/144.2; 15/144.1; 15/172; 15/210.1; 15/244.2; 16/430; 16/900; 403/111

(58) Field of Search ..... 15/144.1, 144.2, 15/145, 172, 210.1, 244.2, 144.3; 16/430, 900; 403/52, 57, 65, 111; 451/523–525

(56) References Cited

U.S. PATENT DOCUMENTS

| | | | | |
|---|---|---|---|---|
| 359,129 | * | 3/1887 | Chamberlain et al. | 15/145 X |
| 432,130 | * | 7/1890 | Fenton | 15/144.2 |
| 1,800,349 | * | 4/1931 | Hurason | 403/57 |
| 2,432,098 | * | 12/1947 | Horn | 15/144.1 |
| 2,796,619 | * | 6/1957 | Hammer | 15/172 |
| 2,810,148 | * | 10/1957 | Wood, Jr. | 15/210.1 |
| 3,473,183 | * | 10/1969 | Burns et al. | 15/144.1 |
| 3,708,821 | * | 1/1973 | Chase et al. | 15/210.1 |
| 3,717,896 | * | 2/1973 | Chase et al. | 15/145 |
| 4,194,852 | * | 3/1980 | Cupp et al. | 15/145 |
| 4,219,899 | * | 9/1980 | Zurawin et al. | 15/144.2 |
| 4,893,370 | * | 1/1990 | Klotz | 15/172 |
| 5,333,347 | * | 8/1994 | Stranders | 15/144.2 |
| 5,836,040 | * | 11/1998 | Giacomelli | 15/172 |

* cited by examiner

*Primary Examiner*—Mark Spisich
(74) *Attorney, Agent, or Firm*—Foley & Lardner

(57) ABSTRACT

A paint applicator (20) has a base (21), a handle (22) mounted on the base for pivotal movement between first and second angular positions in a plane substantially parallel to the surface being painted about a first axis (y-y), an adapter (23) mounted on the handle for pivotal movement between extended and retracted positions in a plane substantially perpendicular to such surface about a second axis (z-z), and a spring (24) acting between the base and adapter for urging the handle to move toward a null position intermediate the first and second positions and for urging the adapter to move toward its retracted position.

26 Claims, 5 Drawing Sheets

PAINT APPLICATOR HAVING EXTENSION-RECEIVING ADAPTER NORMALLY WITHIN PIVOTAL HANDLE

TECHNICAL FIELD

The present invention relates generally to the field of paint applicators and edgers, and, more particularly, to an improved paint applicator having a handle rotatably mounted on a base, and having an extension-receiving adapter pivotally mounted on, but normally concealed within, the handle.

BACKGROUND ART

Paint edgers and applicators are known. These have generally included a relatively-rigid backing plate, a handle mounted on the backing plate, and a relatively-flexible flocked, mohair or synthetic fabric pad removably attached to the backing plate. Where such devices have been used as edgers, the backing plate generally includes a plurality of guide wheels that are adapted to ride along a surface perpendicular to the surface being painted. For example, if the edger is used to paint the upper marginal edge of a wall adjacent a ceiling, the wheels would engage the ceiling and be used to guide the edger there-along.

In some prior art devices, the handle was simply a raised portion of the backing plate. This handle could be manually grasped and used to move the applicator along a wall being painted. This type of applicator is representatively shown and described in U.S. Pat. No. 2,810,148.

Other applicators employed a handle that could be pivotally moved relative to the backing plate about either or both of two mutually-perpendicular axes. The two axes were arranged such that the handle could be moved relative to the backing plate in one plane substantially parallel to the wall being painted, and in another plane substantially perpendicular to the wall. However, this device contemplated that the handle would be locked and held in selected angularly-displaced positions in its respective planes of movement. The handle had an internally-threaded portion that was adapted to matingly receive the externally-threaded marginal end portion of an extension pole so that the applicator could be used to paint hard-to-reach locations. This type of applicator is representatively shown and described in U.S. Pat. No. 3,717,896.

Another type of applicator had a handle that was mounted for pivotal movement relative to the backing plate in a plane generally parallel to the wall being painted. The handle was biased by a leaf spring to a centered or null position intermediate its pivotal limits of motion. This type of applicator is representatively shown and described in U.S. Pat. No. 3,708,821.

Still another type of applicator had a handle that was selectively engageable with a backing plate at any of four equally-spaced angular positions. The handle of this device was also adapted to optionally receive the threaded marginal end portion of an extension pole. This type of applicator is representatively shown and described in U.S. Pat. No. 4,194,852.

The disclosures of the aforesaid '148, '896, '821 and '852 patents are hereby incorporated by reference insofar as the structure and operation of such prior art pad-type applicators is concerned.

It would be generally desirable to provide an improved applicator or edger that afforded pivotal movement of a handle about two mutually-perpendicular axes so that the improved device could be both comfortably grasped by a painter's hand, and more easily used at the distal end of an extension pole.

DISCLOSURE OF THE INVENTION

With parenthetical reference to the corresponding parts, portions or surfaces of the disclosed embodiment, merely for purposes of illustration and not by way of limitation, the present invention provides an improved paint applicator (20) having a relatively-rigid base (21). The improvement broadly comprises: a handle (22) mounted on the base for pivotal movement about a first axis (y-y) between first and second angular positions; an adapter (23) mounted on the handle for pivotal movement about a second axis (z-z) between extended and retracted positions; and a spring (24) acting between the base and adapter for urging said handle to move toward a null position between said first and second angular positions and for urging said adapter to move toward its retracted position. The first and second axes are preferably arranged in substantially perpendicular planes.

The handle is adapted to be grasped by an operator. The adapter has an internally-threaded socket (60) adapted to receive the externally-threaded marginal end portion of an extension pole. The adapter is normally concealed within the profile of said handle, when viewed in side elevation, when the adapter is in its retracted position. The spring is a resilient member, and in the preferred embodiment, may simply be a cylindrical foam plug.

Accordingly, the general object of the invention is to provide an improved applicator or edger for paints and other coatings.

Another object is to provide a versatile paint applicator having a handle that is mounted for pivotal movement relative to the base in a first plane substantially parallel to the surface being painted, and having an adapter that is normally concealed within the elevational profile of the handle but that is mounted for pivotal movement relative to the handle to an extended position in a plane substantially perpendicular to such surface.

Still another object is to provide a versatile paint applicator in which a pivotal handle is biased toward a centered or null position relative to a base, and in which an extension-receiving adapter is biased toward a retracted or concealed position relative to the handle.

These and other objects and advantages will become apparent from the foregoing and ongoing written specification, the drawings, and the appended claims.

DESCRIPTION OF THE PREFERRED EMBODIMENTS

Figure 1:
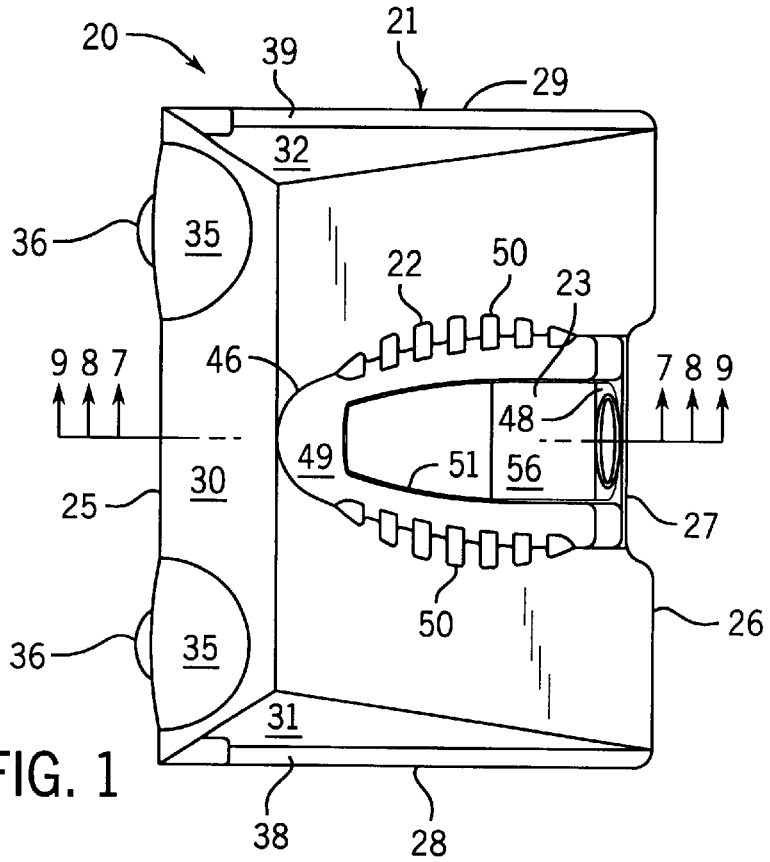
FIG. 1 is a top plan view of the improved applicator showing the handle as being in its centered or null position relative to the backing plate.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 10:
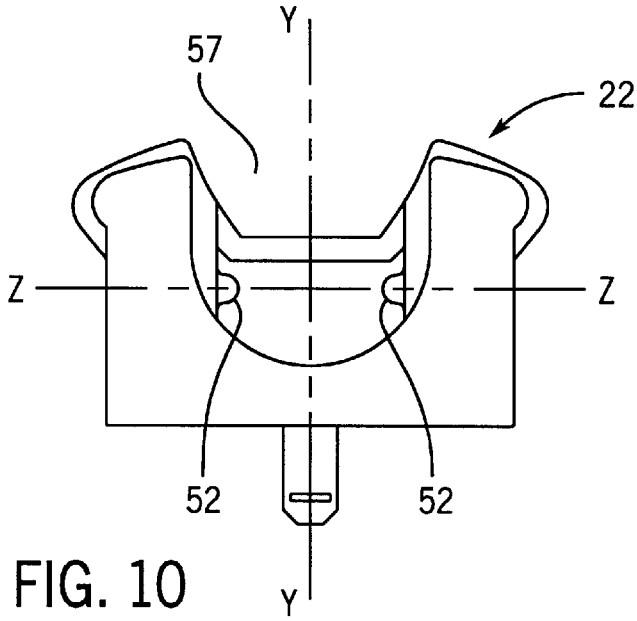
FIG. 10 is a rear elevation of the handle, with the adapter removed.

Referring now to the drawings, and more particularly to FIGS. 1–4 thereof, the present invention provides an improved paint applicator of which a presently preferred form is generally indicated at 20. The improved applicator is shown as broadly including a specially-configured base 21, a handle 22 mounted on the base for pivotal movement about a first access y-y (FIG. 6) between first and second extreme angular positions (FIG. 2) relative to the base, an adapter 23 mounted on the handle for pivotal movement about a second axis z-z (FIG. 10) between relative extended and retracted positions (FIG. 4), and a spring 24 (FIG. 6) acting between the base and adapter for urging the handle to move toward a centered or null position relative to the base (as shown in FIG. 1), and for urging the adapter to move toward its retracted position.

Figure 3:
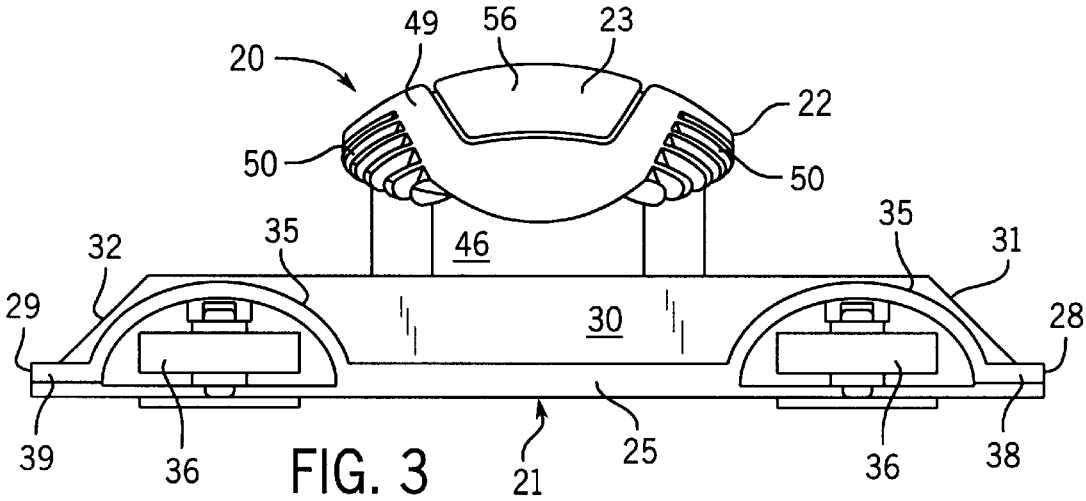
FIG. 3 is a front elevation thereof.
Figure 4:
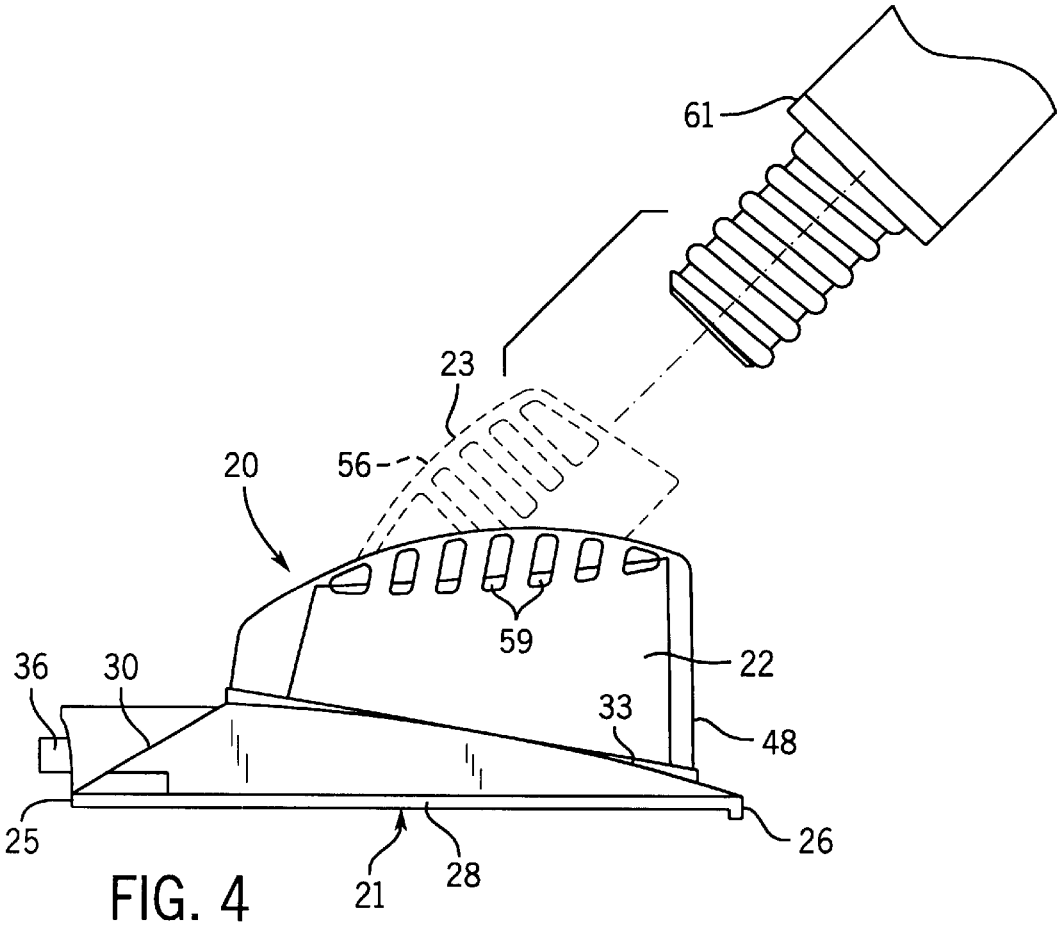
FIG. 4 is a side elevation thereof, showing the adapter as being in its concealed or retracted position, but showing in phantom the adapter as being in its extended position.
Figure 5:
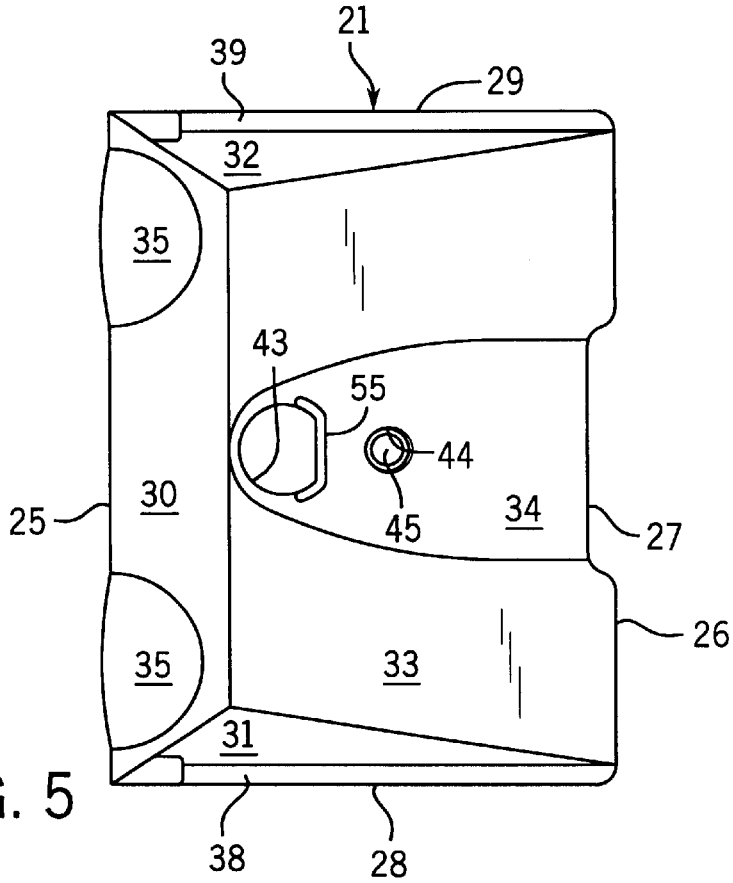
FIG. 5 is a top plan view of the base.
Figure 6:
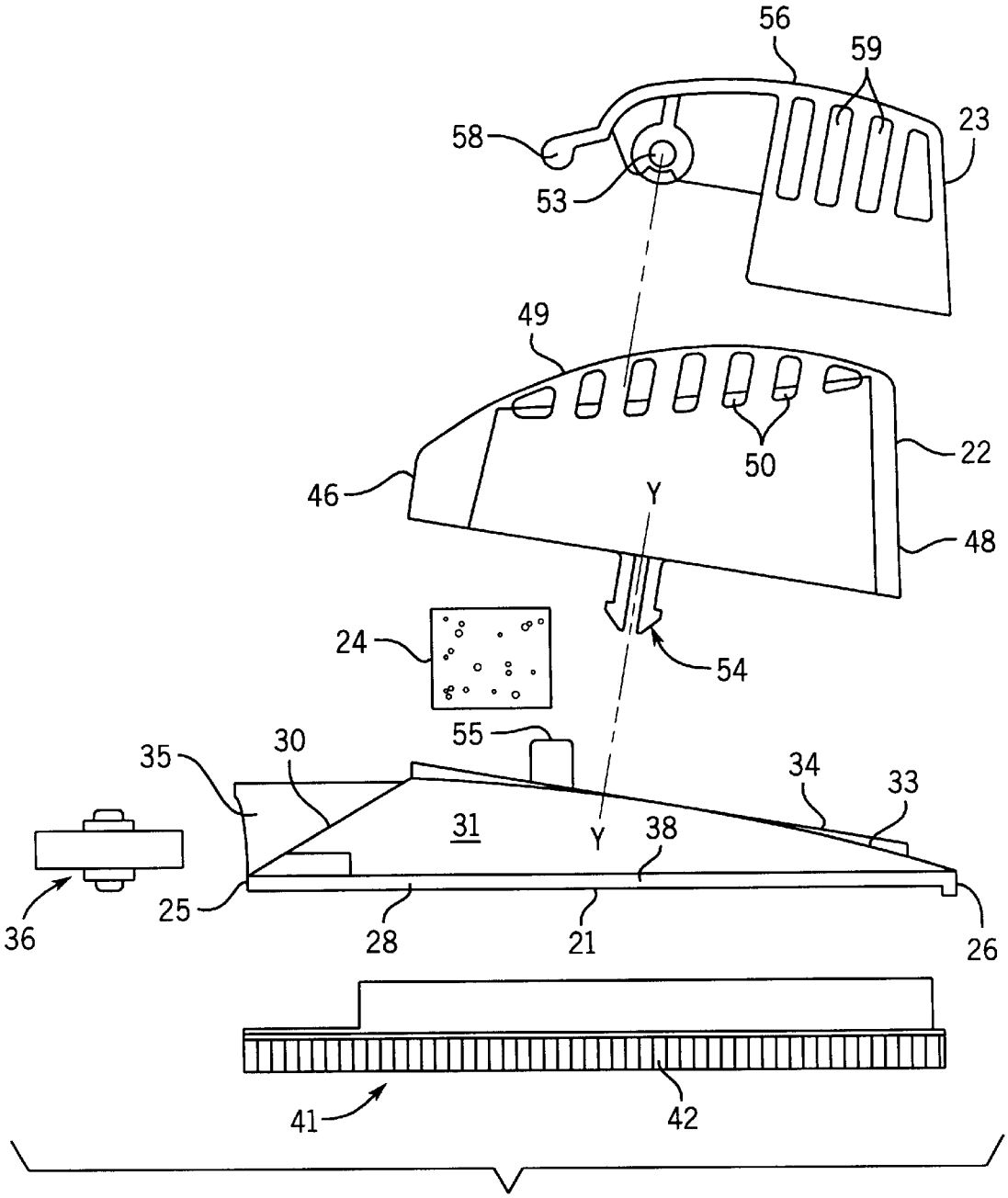
FIG. 6 is a side elevation thereof, showing the backing plate, handle, spring and adapted in exploded aligned relation to one another.

As best shown in FIGS. 1–4, 5 and 9, the base is an injection-molded specially-configured plastic member having a generally rectangular appearance when viewed in top plan. To this extent, the base is shown as having a front edge 25, a rear edge 26 provided with a recessed edge 27, a left side edge 28 and a right side edge 29. The base is preferably formed of a suitable plastic material, and is shown as having a compoundly-sloped stealth-like upper deck including a forwardly-inclined portion 30, laterally-inclined portions 31, 32, respectively, and a rearwardly-inclined portion 33 joining sloped portions 30–32 and rear edge 26, 27. As best shown in FIG. 5, the base also has a somewhat-raised inclined planar portion 34. Two transversely-spaced arcuate cover portions 35 are molded integrally with forwardly-inclined portion 30 and extend rearwardly into the base to join portion 30. These cover portions are designed to receive and accommodate a pair of idler wheels, severally indicated at 36. Thus, these idler wheels may be used to guide the edger along a surface to be painted. For example, if one were to use the edger shown in FIG. 1 to paint the upper margin of a vertical wall, the guide wheels 36 might engage the ceiling to facilitate painting of such upper margin. The lateral margins of surfaces 31 and 32 form out-turned flanges 38, 39, respectively, to receive and accommodate the in-turned flange portions (not shown) of a pad-type applicator, generally indicated at 41 (FIG. 6). This applicator is shown as having a flocked, mohair or synthetic fabric portion 42 that is used to apply the paint or coating to the surface to be coated. Thus, pad 41 may be slidably moved into and out of engagement with the base.

Figure 9:
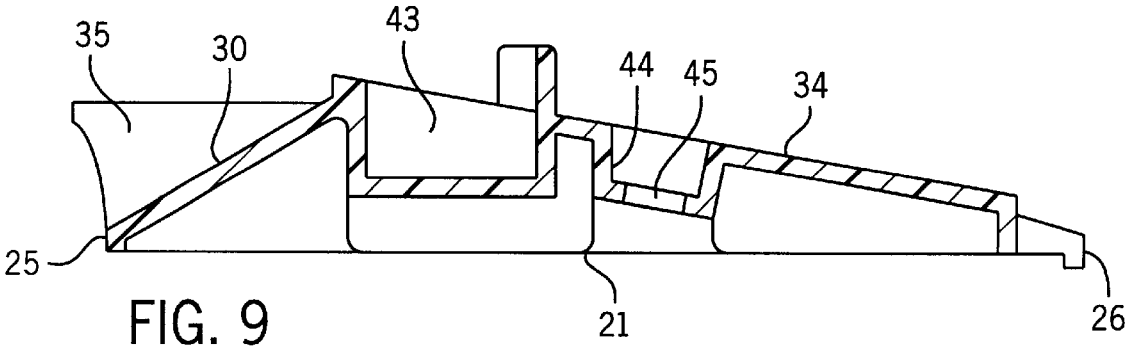
FIG. 9 is a fragmentary vertical sectional view of the base, taken generally on line 9—9 of FIG. 1.

As best shown in FIG. 9, the base is a generally thin-walled member, when seen in vertical cross-section. The base is configured to have an upwardly-opening blind recess 43 to receive the spring. Moreover, the base is further provided with another recess 44 to the rear of recess 43. Recess 44 has a through-hole 45 to receive and accommodate insertion of the depending tangs of the handle, as described infra.

Figure 2:
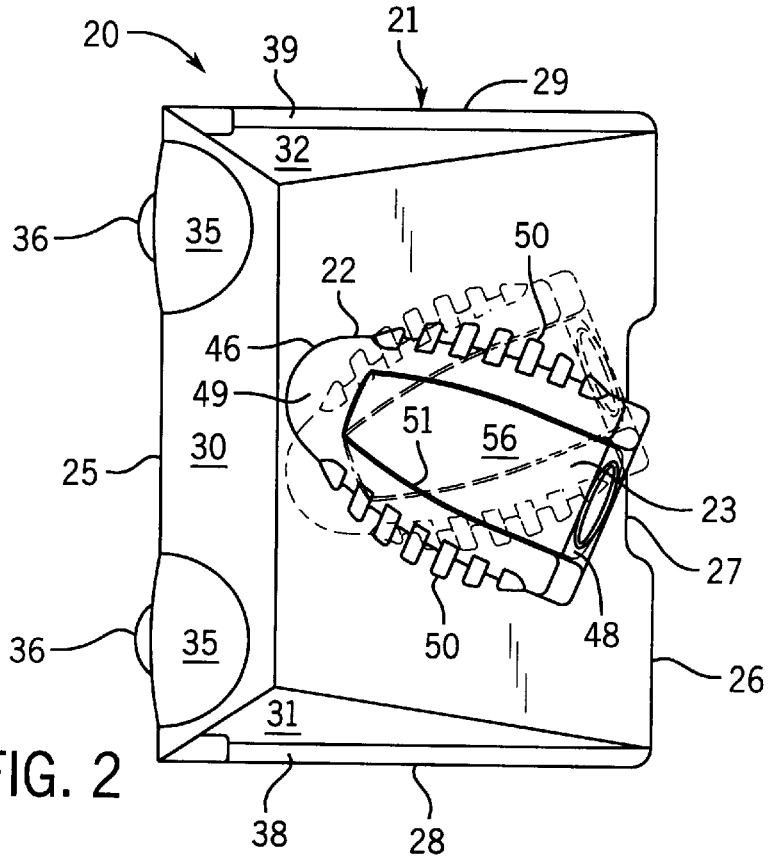
FIG. 2 is a view similar to FIG. 1, but showing in solid the handle as having been rotated to a clockwise extreme position and showing in phantom the handle as having been rotated to a counterclockwise extreme position.
Figure 8:
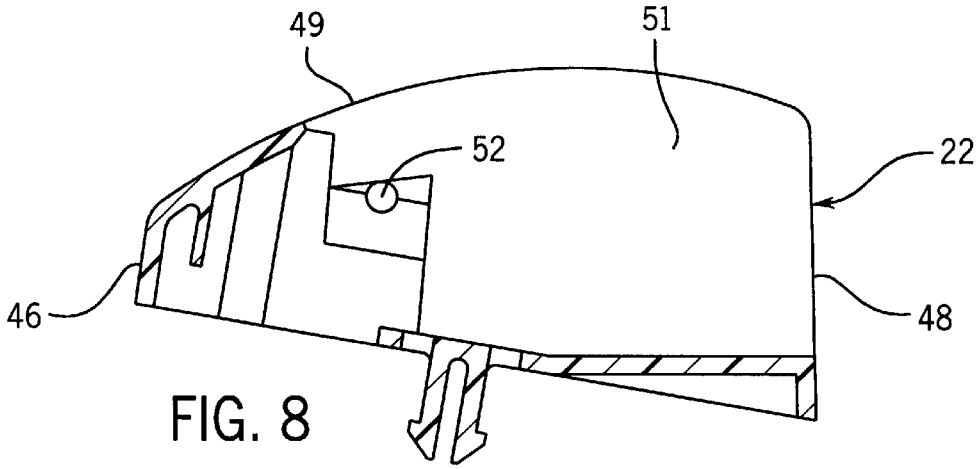
FIG. 8 is fragmentary vertical sectional view of the handle, taken generally on line 8—8 of FIG. 1.

Handle 22 is shown as being an injection-molded specially-configured member having a rounded or convex forward edge 46, a substantially-planar inclined rearward edge 48, an arcuate upper surface 49, and left and right arcuate side surfaces provided with a plurality of grip-enhancing ridges, severally indicated at 50. The handle is also provided with a recess 51 that extends forwardly into the handle from its rear edge 48. As best shown in FIG. 8, the handle is also a thin-walled tubular member, having on either side of the recess, an inwardly-facing short projection 52 which is adapted to be received in holes 53 provided in the adapter. A bifurcated hook-like projection, generally indicated at 54, extends downwardly from the lower edge of the handle, and is adapted to be snapped through base hole 45. Thus, when the handle is snapped into engagement with the base, the handle is normally free to rotate about axis y-y between two extreme limits of angular movement. In FIG. 1, the handle is shown as being in a centered or null position relative to the base. In FIG. 2, the handle is shown in solid as having been rotated about 20° in a clock-wise direction to one extreme angular position, and, in phantom, has having been rotated about 20° in a counterclockwise direction to another extreme angular position. These two positions show the limits of motion of the handle relative to the base. These limits are defined by the edges of a U-shaped lug 55 rising upwardly from the base to the immediate rear of hole 43. If desired, a washer (not shown) may be arranged within the body, and engaged by the projections 54 to facilitate sliding movement of the handle relative to the base.

Figure 7:
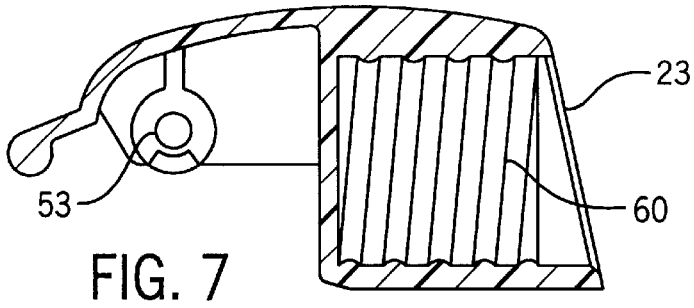
FIG. 7 is a fragmentary vertical sectional view of the adapter, taken generally on line 7—7 of FIG. 1.

Referring now to FIGS. 4, 6 and 7, the adapter 23 is also shown as being an injection-molded specially-configured plastic member. The adapter is mounted on the handle for pivotal movement between extended and retracted positions. When in its retracted position, the adapter is substantially concealed within the outline, when viewed in side elevation, of the handle. The concealed position is representatively shown in FIGS. 1–3. However, the adapter may be pivoted about the axis z-z defined by the contact between pins 52 and holes 53, to an extended position as shown in phantom in FIG. 4. As best shown in FIGS. 4 and 6, adapter 23 has an upper arcuate surface 56 which appears to tangentially join the proximate margins of handle upper surface 49 when the adapter is in its retracted position. The adapter has a forwardly-extending tang 58 (FIG. 6) which is normally concealed within the handle, has holes 53 to receive handle nubs 52, 52, and has a thickened rearward portion provided with a plurality of grooves, severally indicated at 59. As best shown in FIG. 7, the adapter has a rearwardly-opening internally-threaded blind recess 60 which is adapted to receive mating insertion of the externally-threaded portion of an extension pole 61, a proximate marginal portion of which is shown in phantom in FIG. 4.

The apparatus is assembled as shown, with spring member 24 being received in base recess 43. The upper marginal end face of the spring bears against tang 58, and urges it upwardly. Thus, adapter 23 is an intermediately-pivoted member, and the spring continuously urges the adapter to move towards its concealed position relative to the handle. The spring also urges or biases the handle towards its centered or null position as shown in FIGS. 1 and 3, relative to the body. Thus, the spring performs to two functions. It first biases the adapter to move toward its retracted position relative to the handle, and, secondly, it also urges the handle to move toward its centered or null position relative to the base.

Thus, the improved adapter is exceedingly useful and versatile. First, it retains many of the advantages of conventional pad-type applicators, such as the ability to use guide wheels 36 to paint the marginal portion of a wall adjacent a ceiling, for example. By the same token, since the handle is mounted for pivotal movement on the base, the device is comfortable to the user who may wish to have the handle pivot as the adapter is moved outwardly toward the end of the painter's reach. At the same time, the improved device has an adapter pivotally mounted on the handle. This adapter is normally concealed and unobtrusive when the painter holds the handle in his hand. However, the painter may readily thread an extension pole into engagement with the handle, to paint overhead out-of-the-reach positions. Here, the handle has two degrees of freedom in that the handle is mounted for pivotal movement relative to the base, and the adapter is mounted for pivotal movement relative to the handle. This affords a high degree of flexibility particularly when painting overhead.

Modifications

Of course, many changes and modifications may be made. For example, the shape and configuration of the base, as well as the material of its construction, may be readily changed as desired. The base may incorporate wheels if desired. These may be omitted if need be.

The shape and configuration of the handle may be readily changed. The particular means by which the handle is secured to the base may also be changed, this being clearly within the range of one skilled in the art. Also, while it is presently desired to have an unobtrusive adapter, it is pointed out that the shape and configuration of the adapter may also be changed. Finally, while the use of a low-cost foam cylindrical plug as the spring is preferred for cost reasons, it is pointed out that other types of springs may alternatively be used.

Therefore, while preferred forms of the improved applicator have been shown and described, and certain modifications and changes thereof discussed, persons skilled in this art will readily appreciate that various additional changes and modifications may be made without departing from the spirit of the invention, as defined and differentiated by the following claims.

What is claimed is:

1. A paint applicator comprising:

a base;

a paint applying medium coupled to the base;

a handle mounted on said base for pivotal movement about a first axis between first and second relative angular positions;

an adapter mounted on said handle for pivotal movement about a second axis between extended and retracted positions, wherein said adapter has an internally-threaded socket; and a spring acting between said base and adapter for urging said handle to move toward a null position between said first and second angular positions and for urging said adapter to move toward said retracted position.

2. The applicator as set forth in claim 1 wherein said handle is adapted to be grasped by an operator.

3. The applicator as set forth in claim 1 and further comprising an extension pole provided with an externally-threaded portion that is adapted to be matingly received in said socket.

4. The applicator as set forth in claim 1 wherein said adapter is substantially concealed within the profile of said handle when said adapter is in said retracted position.

5. The applicator as set forth in claim 1 wherein said spring is a resilient member.

6. The applicator as set forth in claim 1 wherein the paint applying medium comprises a pad assembly releasably attached to said base.

7. The applicator as set forth in claim 1 wherein said first and second axes are arranged in substantially perpendicular planes.

8. A hand tool for use with an extension pole, the hand tool comprising:

a base generally extending in a plane;

a handle pivotably coupled to the base for pivotal movement about a first axis extending perpendicular to the plane; and an adapter pivotably coupled to the handle for pivotal movement about a second axis extending parallel to the plane, wherein the adapter is adapted to be releasably coupled to an extension pole, wherein the handle includes a cavity and wherein the adapter pivots between a retracted position in which the adapter is received within the cavity and an extended position in which the adapter projects out of the cavity.

9. The tool of claim 8 wherein the adapter includes a mounting portion adapted to be releasably coupled to the extension pole and wherein the mounting portion includes a bore adapted to receive an axial end of the extension pole.

10. The tool of claim 8 wherein the handle has a first upper surface opposite the base, wherein the adapter has a second upper surface opposite the base and wherein the first surface and the second surface are flush with one another when the adapter is in the retracted position.

11. The tool of claim 10 wherein the first surface and the second surface are convex such that both the first surface and the second surface face a user's palm when the handle is grasped by the user while the adapter is in a the retracted position.

12. The tool of claim 8 wherein the handle is configured to be pivoted between a centered position and an angled position.

13. The tool of claim 12 wherein the longitudinal axis of the handle extends perpendicular to the longitudinal axis of the base when the handle is in the centered position.

14. The tool of claim 12 wherein the handle is resiliently biased towards the centered position.

15. The tool of claim 8 wherein the base has a major longitudinal dimension and a minor transverse dimension, wherein the handle has a major longitudinal dimension and a minor transverse dimension, wherein the handle is configured to be pivoted between a centered position and an angled position, wherein the adapter is resiliently biased towards the retracted position and wherein the handle is resiliently biased towards the centered position.

16. The tool of claim 15 including a resilient biasing member biasing both the adapter towards the retracted position and the handle towards the centered position.

17. The tool of claim 8 wherein the adapter is substantially concealed within a profile of the handle when the adapter is in the retracted position.

18. The tool of claim 8 including a paint applying medium releasably coupled to the base.

19. The tool of claim 8 wherein the adapter includes an internally-threaded socket.

20. A hand tool for use with an extension pole, the hand tool comprising:

a base;

a handle pivotably coupled to the base and including a cavity;

an adapter pivotably coupled to the handle and adapted to be releasably coupled to the extension pole, the adapter pivoting between a retracted position in which the adapter is received within the cavity and an extended position in which the adapter projects out of the cavity.

21. The tool of claim 20 wherein the base generally extends in a plane, wherein the handle pivots about a first axis extending perpendicular to the plane and wherein the adapter pivots about a second axis extending parallel to the plane.

22. The tool of claim 20 wherein the handle has a first upper surface opposite the base, wherein the adapter has a second upper surface opposite the base and wherein the first upper surface and the second upper surface are flush with one another when the adapter is in the retracted position.

23. The tool of claim 20 including a paint-applying medium coupled to the base.

24. The tool of claim 20 wherein the adapter is resiliently biased towards the retracted position.

25. The tool of claim 24 wherein the handle pivots between a centered position and an oblique position, wherein the handle is resiliently biased towards the centered position.

26. The tool of claim 20 wherein the handle pivots between a centered position and an oblique position and wherein the handle is resiliently biased towards the centered position.

* * * * *